US007207899B2

(12) United States Patent
Imamoto

(10) Patent No.: US 7,207,899 B2
(45) Date of Patent: Apr. 24, 2007

(54) GOLF CLUB HEAD

(75) Inventor: Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 380 days.

(21) Appl. No.: 10/268,098

(22) Filed: Oct. 10, 2002

(65) Prior Publication Data

US 2004/0043830 A1 Mar. 4, 2004

(30) Foreign Application Priority Data

Aug. 30, 2002 (JP) ..... P2002-254608

(51) Int. Cl.
*A63B 53/04* (2006.01)

(52) U.S. Cl. ..... 473/332; 473/345; 473/350

(58) Field of Classification Search ..... 473/325, 473/329, 342

See application file for complete search history.

(56) References Cited

U.S. PATENT DOCUMENTS

| | | | | |
|---|---|---|---|---|
| 4,804,188 | A * | 2/1989 | McKee et al. | 473/342 |
| 5,564,705 | A * | 10/1996 | Kobayashi et al. | 473/334 |
| 5,692,972 | A * | 12/1997 | Langslet | 473/332 |
| 5,766,092 | A | 6/1998 | Mimeur et al. | |
| 6,045,456 | A * | 4/2000 | Best et al. | 473/291 |
| 6,093,116 | A * | 7/2000 | Hettinger et al. | 473/332 |

FOREIGN PATENT DOCUMENTS

| | | |
|---|---|---|
| JP | 53-65128 | 6/1978 |
| JP | 5-293201 | 11/1993 |
| JP | 9-24125 | 1/1997 |
| JP | 9-215795 | 8/1997 |
| JP | 11104283 A * | 4/1999 |

OTHER PUBLICATIONS

"Sorbothane Frequently asked Questions", Sorborthane, Inc. Revised Oct. 23, 2001, www.sorbothane.com.*

"Performance Characteristics," Sorbothane Incorporated, copyright 1997-99.*

"Sorbothane Info," Colin Kaminski, printed Jun. 2001.*

* cited by examiner

*Primary Examiner*—Eugene Kim
*Assistant Examiner*—Alvin A. Hunter, Jr.
(74) *Attorney, Agent, or Firm*—Sughrue Mion, PLLC

(57) ABSTRACT

A golf club head having a head body, a face plate fixedly attached to the front surface of the head body, a weight fixedly attached to the front surface of the sole portion of the head body, and an elastic body charged into a first recess portion of the golf club head. The elastic body is compressed to stick fast to the rear surface of the face plate. The lower portion of the head body having first and second recess portions is formed as a bulging portion bulging at the rear of the head body. The JIS C hardness of the elastic body is preferably 15–80, more preferably 18–70, most preferably 20–60.

10 Claims, 2 Drawing Sheets

GOLF CLUB HEAD

The present disclosure relates to the subject matter contained in Japanese Patent Application No. 2002-254608 filed on Aug. 30, 2002, which is incorporated herein by reference in its entirety.

BACKGROUND OF THE INVENTION

1. Field of the Invention

The present invention relates to a golf club head, and particularly relates to a golf club head having a hollow portion to which an elastic body is inserted.

2. Description of the Related Art

JP-A-9-2412 discloses a golf club head in which rubber, a rubber-like elastic body or a spring is provided in a hollow portion formed between a face surface and a golf club head back surface. The publication also discloses that the rubber is inserted while being compressed slightly. In addition, the publication discloses that the golf club head includes a head body and a face plate attached to the front surface of the head body.

JP-A-9-215795 discloses that a fibriform shock absorber is disposed in a hollow portion.

JP-A-53-65128 discloses that liquid epoxy resin is introduced into a cavity forming a hollow portion and is hardened.

JP-A-5-293201 discloses that cohesive synthetic resin is applied to a recess portion provided in a face surface, next a face plate is disposed in the recess portion, and then the synthetic resin is thermally hardened.

U.S. Pat. No. 5,766,092 discloses a golf club head in which foaming liquid resin is poured into a hollow portion and foams in the hollow portion so that the hollow portion is filled with foamable plastic.

SUMMARY OF THE INVENTION

In each of the related-art golf club heads, the center of gravity is high. An object of the present invention is to lower the center of gravity of a golf club head in which an elastic body has been disposed in a hollow portion.

The invention provides a golf club head in which an elastic body is inserted into a hollow portion formed between a face surface and a golf club head back surface, and the hollow portion is formed only in a lower portion of the golf club head.

The center of gravity of such a golf club head is low because the hollow portion is provided only in the lower portion of the golf club head. Particularly, when the golf club head includes a head body and a face plate attached to the front surface of the head body and an opening portion penetrating an upper portion of the head body in the back/forth direction thereof is provided in the upper portion of the head body, the center of gravity of the golf club head can be lowered sufficiently. In this case, it is preferable that the face plate is fixed to the head body by caulking the circumferential edge portion of the head body.

The invention is suitably applied to an iron type golf club head or a utility type golf club head. The utility type golf club head means a golf club head whose size in the back/forth direction is larger than that of an existing iron type golf club head but is not as large as that of a wood type golf club head.

When an elastic body is inserted into the hollow portion with being compressed so that the elastic body sticks to a front wall portion (for example, the rear surface of the face plate) in the hollow portion, the feeling of hitting with the golf club head is improved.

Particularly, when the rearmost portion in the hollow portion is formed as a space where there is no elastic body, the elastic body can be elastically deformed to enter the space at the moment of ball hitting, and the face surface can be also elastically deformed. Thus, the repulsion property of a ball can be also improved.

In the invention, it is preferable that the elastic body is disposed at least in a standard ball hit area.

When an elastic body having 15–80 in JIS C hardness is used as the elastic body, a good feeling of ball hitting at the moment of hitting a ball can be obtained.

It is preferable that the elastic body is made of thermoplastic elastomer.

DETAILED DESCRIPTION OF THE PREFERRED EMBODIMENTS

Description will be made below on embodiments of the invention with reference to the drawings.

Figure 1A:
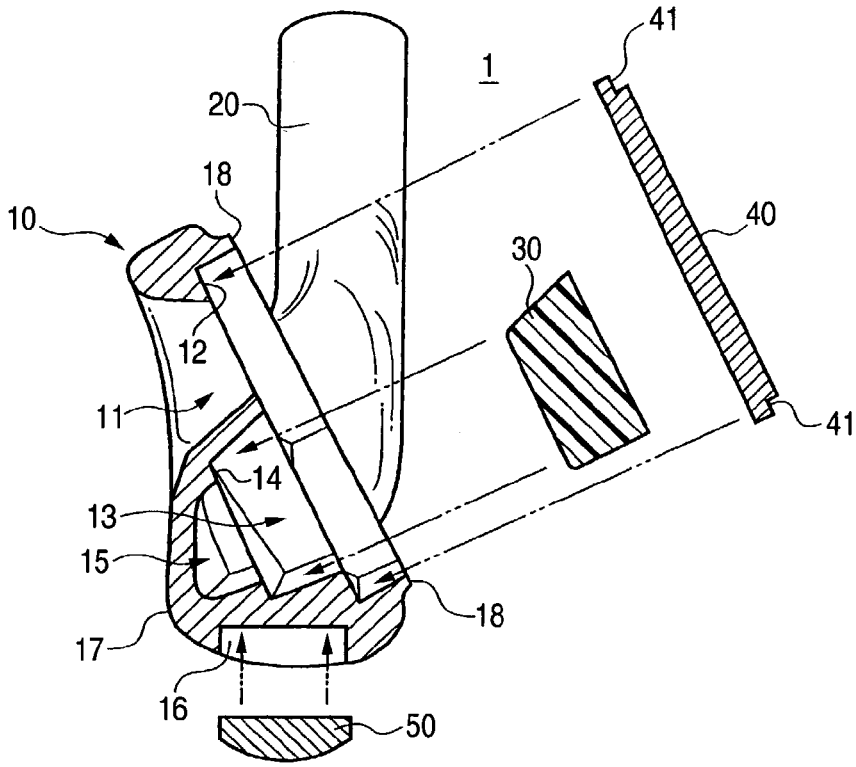
FIG. 1 is an exploded sectional view and a longitudinal sectional view of a golf club head according to an embodiment of the invention, taken at a center in the face width direction thereof.
Figure 1B:
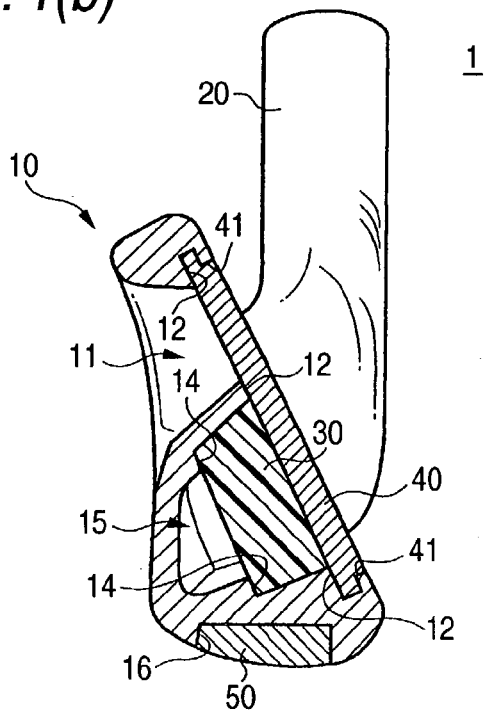
Figure 2:
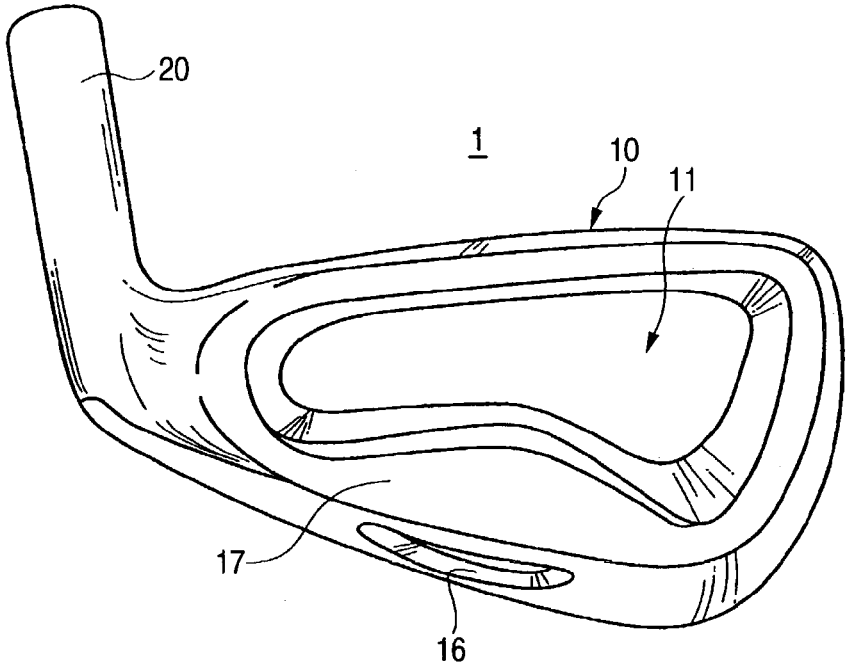
FIG. 2 is a perspective view of a head body from a slightly lower side in a rear direction thereof.
Figure 3:
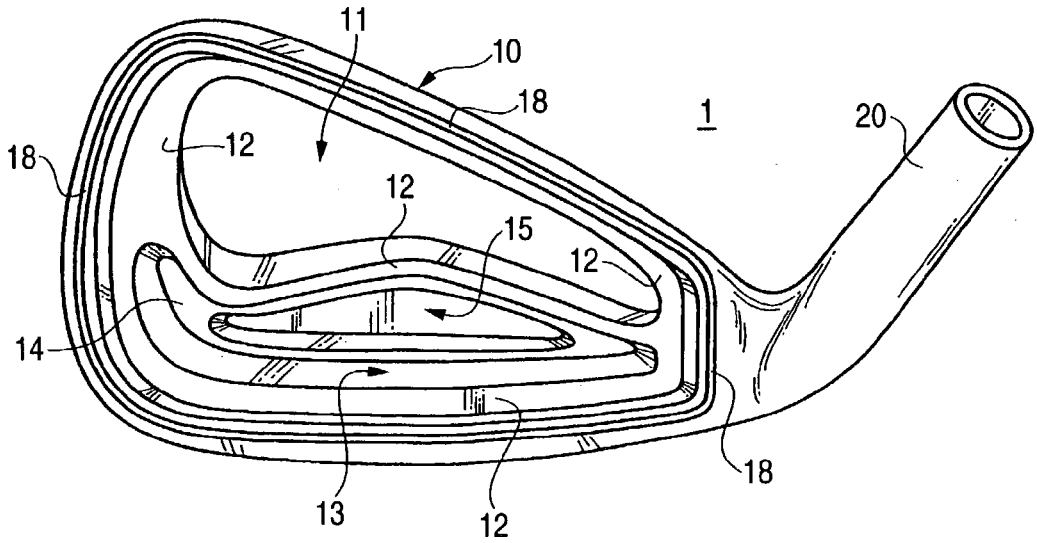
FIG. 3 is a perspective view of the head body from a slightly upper side in a front direction thereof.

FIGS. 1A and 1B are an exploded sectional view and a longitudinal sectional view of a golf club head according to an embodiment of the invention, taken at a center in the face width direction thereof. FIG. 2 is a perspective view of a head body from a slightly lower side in a rear direction thereof. FIG. 3 is a perspective view of the head body from a slightly upper side in a front direction thereof.

A golf club head 1 according to this embodiment has a head body 10, a face plate 40, a weight 50 and an elastic body 30. The face plate 40 is fixedly attached to the front surface of the head body 10. The weight 50 is fixedly attached to the bottom surface of a sole portion of the head body 10. The elastic body 30 is inserted into a hollow portion in the golf club head 1.

In the upper portion of the head body 10, an opening portion 11 is formed to penetrate the upper portion of the head body 10 in the back/forth direction of its face. The circumferential edge portion of the front surface of the head body 10 is formed into a step portion 12 to which the face plate 40 is fitted. This face plate 40 is a little smaller than the face surface of the head body 10 and substantially similar in figure to the face surface. It is preferable that distance between a salient edge of the step portion 12 and the outer circumferential edge of the head body 10 (only upper, lower and toe edges) is about 2.5–4 mm.

In the lower portion of the head body, a first recess portion 13 is formed to be open to the front. A second recess portion 15 is provided to follow the bottom surface portion of the first recess portion 13. The bottom surface of the second recess portion 15 is smaller than the bottom surface of the first recess portion 13. Thus, the bottom surface of the first recess portion 13 forms a step portion 14.

The lower portion of the head body having the first and second recess portions 13 and 15 is formed as a bulging portion 17 bulging toward the rear direction of the head body. This bulging portion 17 is provided substantially all over the width-direction range of the head body 10 ranging from its toe side to its heel side.

It is preferable that the first recess portion 13 has a toe/heel direction width corresponding to about 30–90% of the toe/heel direction width of the face plate 40. The toe/heel direction width of the second recess portion 15 may be set desirably so long as it is not larger than the toe/heel direction width of the first recess portion 13. Incidentally, the toe/heel width means the maximum width in the toe/heel direction.

It is preferable that the up/down direction width (providing that it means the maximum width in a direction parallel to the face surface) of the first recess portion 13 is 3–25 mm. The up/down direction width of the second recess portion may be set desirably so long as it is smaller than the up/down direction width of the first recess portion. It is, however, preferable that the up/down direction width of the second recess portion is 2–24 mm. It is desired that the maximum width portions of the recess portions 13 and 15 are located near the face center (that is, a center of corrugations (grooves) provided in the face surface, in the length direction).

It is preferable that the opening area of the second recess portion 15 is about 30–95% of the opening area of the first recess portion 13. It is preferable that the width of the step portion 14 is 0.5–8 mm, particularly 1–5 mm, on the upper side and lower side of the second recess portion 15. It is preferable that the width of the step portion 14 is 1–10 mm, particularly 1–5 mm, on the toe side and heel side of the second recess portion 15.

In the center of the corrugations (grooves) in the face surface in the length direction, it is preferable that the elastic body 30 exists in a ball hit area at the time of a regular shot (excluding miss shots such as chunk, top or shank). Accordingly, since the diameter of a golf ball is 42.67 mm, it is preferable that the elastic body 30 exists at the hitting height HT defined in the following equation in the center of the golf club head in the width direction.

$$HT\ (\text{mm})=(42.67/2)(1-\sin\theta)$$

where θ designates the loft angle of the golf club head.

In this embodiment, the first recess portion 13 is designed to show a triangle bent convexly upward at the center in the face width direction. By employing this structure, the elastic body is supported at the hitting height HT. In the both sides of this center portion, the upper edge of the first recess portion 13 becomes lower in level as it goes away from the center portion. Thus, the center of gravity of the golf club head 1 is lowered.

It is preferable that the depth of the first recess portion 13 is not smaller than 3.5 mm, particularly not smaller than 4 mm, more particularly not smaller than 4.5 mm, and not larger than 20 mm, particularly not larger than 10 mm. It is preferable that the depth of the second recess portion 15 is 1–10 mm, particularly 3.5–10 mm. It is preferable that the volume of the first recess portion 13 is 3–30 times, particularly 3.5–20 times, as large as the volume of the second recess portion 15.

A rib 18 is provided around the edge portion of the step portion 12. This rib 18 is deformed by caulking when the face plate 40 is fixed. A concave step portion 41 is provided circumferentially in the circumferential edge portion of the face plate 40. The caulked rib 18 is engaged with the step portion 41. It is preferable that the thickness of the face plate 40 is 1–4 mm, particularly 1.5–3.5 mm. When the thickness of the face plate 40 is in this range, the feeling of hitting is improved while the repulsion property is also enhanced by use of the deformation of the face plate.

Incidentally, a hosel portion 20 is provided on the heel side of the head body 10. A recess portion 16 is provided in the bottom surface (sole surface) of the head body 10. The weight 50 made of metal having a high specific gravity, such as a tungsten alloy, is fixedly attached to the recess portion 16 by fitting or welding.

To assemble the golf club head 1, the elastic body 30 a little larger in size than the first recess portion 13 is fitted into the first recess portion 13. By this fitting, the rear surface of the elastic body 30 abuts against the step portion 14 so that the front surface of the elastic body 30 protrudes slightly from the step portion 12 (preferably by 2–50% of the thickness of the elastic body 30, more preferably by 5–15% likewise). Next, the face plate 40 is engaged with the step portion 12 and the rib 18 is caulked so that the face plate 40 is fixedly attached to the head body 10. The elastic body 30 is pushed by the face plate 40 so as to be inserted into the recess portion 13 while being compressed. Then, the front surface of the elastic body 30 as a whole sticks fast to the rear surface of the face plate 40.

It is preferable that the material of the elastic body 30 is elastomer having elasticity. Suitable examples thereof include styrene-based elastomer, olefin-based elastomer, urethane-based elastomer, ester-based elastomer, amide-based elastomer, 1,2-polybutadiene, ionomer resin, and transpolyisoprene. Particularly, urethane-based elastomer, amide-based elastomer, and 1,2-polybutadiene are preferred.

When the elastomer is thermoplastic elastomer, it is preferable that the softening temperature thereof is not lower than 80° C. This is because the elastomer of the golf club put in a trunk of a car in summer daytime is prevented from being thermoplastically deformed.

When the JIS C hardness of the elastic body 30 is 15–80, particularly 18–70, more particularly 20–60, the feeling of hitting with the golf club head 1 is improved.

It is preferable that before the elastic body 30 is attached to the first recess portion 13, the projected shape of the elastic body 30 on the face surface of the first recess portion 13 is equal to or a little smaller than that of the first recess portion 13.

Examples of materials for the face plate 40 include stainless steel, maraging steel, copper alloys such as brass, beryllium copper and bronze, titanium, titanium alloys, duralumin or high strength aluminum alloys, amorphous metals, and FRM.

A golf club head whose head body is made of stainless steel or soft iron (specific gravity 7.8) and whose face member is made of a titanium alloy (specific gravity 4.2–5.0) or duralumin (specific gravity 2.8) has a deep center of gravity. A face plate made of a copper alloy increases the degree of backspin of a ball hit by the golf club head 1. A face plate made of a Zr-based amorphous alloy is low in Young's modulus to be about 85–100 GPa. Thus, the coefficient of restitution of a golf club head having such a face plate is increased so that the initial speed of a ball is increased.

In a golf club head having a face plate low in Young's modulus, the face plate is apt to be bent large at the time of a shot. However, the elastic body 30 disposed at the rear of the face plate prevents large bending of the face plate, so as to suppress the vibration of the face plate.

The material of the head body may be the same as or different from the material of the face plate.

In the golf club head 1 configured thus, the bulging portion 17 having a hollow portion (the first recess portion 13 and the second recess portion 15) is disposed only on the lower side of the back surface of the golf club head 1. Thus, the center of gravity of the golf club head 1 is low. Particularly, since the opening portion 11 is provided in the upper portion of the head body 10, the weight on the upper side of the head body 10 is small enough to lower the center of gravity of the golf club head 1.

In addition, in this golf club head 1, the elastic body 30 is inserted in the first recess portion 13 while being compressed, and all the front surface of the elastic body 30 sticks fast to the rear surface of the face plate 40. Thus, the vibration generated when a ball is hit is absorbed in the elastic body 30 so that the feeling of hitting is improved.

In this embodiment, the inside of the second recess portion 15 is formed as a space where the elastic body 30 is absent. Accordingly, when a ball is hit, the elastic body 30 is elastically deformed so that the rear portion thereof enters the second recess portion 15. Thus, the ball repulsion property of the golf club head 1 is enhanced.

EXAMPLES

Description will be made below on manufacturing examples of the illustrated golf club heads and their properties.

Example 1

The head body shown in FIGS. 1A and 1B, FIG. 2 and FIG. 3 was manufactured by casting from SUS630 stainless steel. The depth of the first recess portion was 8 mm, the opening area of the first recess portion was 2,200 $mm^2$, the volume $V_1$ of the first recess portion was 17,600 $mm^3$, the average depth of the second recess portion was 3.5 mm, the opening area of the second recess portion was 1,300 $mm^2$, the volume $V_2$ of the second recess portion was 4,550 $mm^3$, and $V_1/V_2=3.9$.

The loft angle of the head body was 25° (corresponding to a number 5 iron), and the hitting height HT was $HT=(42.67/2)\cdot(1-\sin\theta)=12.32$ mm. The highest portion of the elastic portion from the sole surface at the center portion in the width direction of the face surface was set to be 20 mm. Not to say, this value was larger than the value 12.32 mm.

The material of the elastic body was polyester-based TPE (thermoplastic polyester). The volume $V_3$ of the elastic body was 19,000 $mm^3$, and the thickness of the elastic body was 8.6 mm. The JIS C hardness of the elastic body was 23. The projected shape of the elastic body on the face surface accorded with the shape of the first recess portion.

The face plate was made of a titanium alloy of Ti-6Al-4V, which was 2 mm thick. The face plate was fixed to the head body 10 by caulking the rib 18. The elastic body was compressed by attaching the face plate. Compressibility C of the elastic body on the assumption that the elastic body is present only in the first recess portion is $C=V_3/V_1=19000/17600=1.08$.

A weight of tungsten weighing 18g was attached to the sole. A carbon shaft was attached to the golf club head so that a number 5 iron having 37 inches long was manufactured. Table 1 shows the results of trial shots carried out with this number 5 iron by a professional golfer.

Examples 2 to 6

Number 5 irons having the same loft angle as that in Example 1 were manufactured in the same manner as in Example 1, except that the dimensions of respective portions of the head bodies, and the material and thickness of the elastic body were set as shown in Table 1. (Incidentally, no elastic body was adopted in Example 5.) Table 1 also shows the results of trial shots likewise.

Incidentally, "easiness to launch a ball" in Table 1 means easiness to obtain an aimed ball launch angle.

TABLE 1

| | | Ex. 1 | Ex. 2 | Ex. 3 | Ex. 4 | Ex. 5 | Ex. 6 |
|---|---|---|---|---|---|---|---|
| face plate thickness (mm) | | 2 | 2 | 2 | 2 | 2 | 2 |
| HT = (42.67/2) · (1 − sin) (mm) | | 12.32 | 12.32 | 12.32 | 12.32 | 12.32 | 12.32 |
| elastic body height at face center (mm) | | 20 | 25 | 25 | 17 | none | 40.5 (overall) |
| opening area of first recess portion ($mm^2$) | | 2200 | 2200 | 2200 | 2200 | 2200 | 4500 |
| depth of first recess portion (mm) | | 8 | 8.5 | 8.5 | 6.5 | 8 | 8 |
| volume $V_1$ of first recess portion ($mm^3$) | | 17600 | 18700 | 18700 | 14300 | 17600 | 36000 |
| opening area of second recess portion ($mm^2$) | | 1300 | 1300 | 1300 | 1300 | 1300 | 1300 |
| average depth of second recess portion (mm) | | 3.5 | 3.8 | 3.8 | 4.5 | 3.5 | 3.5 |
| volume $V_2$ of second recess portion ($mm^3$) | | 4550 | 4940 | 4940 | 5850 | 4550 | 4550 |
| JIS C hardness of elastic body | | 23 | 23 | 32 | 95 | none | 23 |
| initial thickness of elastic body (mm) | | 8.6 | 9.0 | 9.0 | 7.3 | none | 4.7 |
| initial volume $V_3$ of elastic body ($mm^3$) | | 19000 | 19800 | 19800 | 15000 | none | 21150 |
| compressibility of elastic body ($V_3/V_1$) | | 1.08 | 1.06 | 1.06 | 1.05 | none | 1.13 |
| volume ratio of elastic body to second recess portion $V_3/V_2$ | | 4.18 | 4.01 | 4.01 | 2.56 | | 36.12 |
| material of elastic body | | polyester-based TPE | | styrene-based TPE | ionomer | none | polyester-based TPE |
| result of trial shots | feeling of hitting | extremely good | | | baddish | extremely bad | goodish |
| | easiness to launch a ball | | | easy | | | difficult |

As shown in Table 1, in the golf club heads in Examples 1 to 3, the feeling of hitting was good, and it was easy to launch a ball. On the other hand, in Example 4, the JIS hardness of the elastic body was so high that it was indeed easy to launch a ball but the feeling of hitting was baddish. In Example 5, the feeling of hitting was bad because there was no elastic body. In Example 6, the elastic body was disposed all over the back surface of the face plate, that is, substantially all over the face surface. Therefore, the center of gravity of the golf club head was so high that it was difficult to obtain a high launch angle.

As has been described, according to the invention, a golf club head, which is good in feeling of ball hitting and high in launch angle, is provided.

What is claimed is:

1. A golf club head made of metal, comprising:

a face surface; and a head body; wherein:

the head body includes a first hollow portion:

an elastic body is inserted into the first hollow portion;

the first hollow portion is formed only in a lower portion of the head body; and a second hollow portion communicating with the first hollow portion.

2. The golf club head according to claim 1, wherein an opening area of the first hollow portion is larger than that of the second hollow portion.

3. The golf club head according to claim 1, wherein a volume of the first hollow portion is larger than that the second hollow portion.

4. The golf club head according to claim 1, wherein a volume of the first hollow portion is 3–30 times as large as that of the second hollow portion.

5. The golf club head according to claim 1, wherein the elastic body is absent in the second hollow portion.

6. A golf club head made of metal, comprising:

a face surface;

and a head body; wherein:

the head body includes a first hollow portion:

an elastic body is inserted into the first hollow portion;

the first hollow portion is formed only in a lower portion of the head body; wherein JIS C hardness of the elastic body is in a range of 20–60, and a second hollow portion communicating with the first hollow portion.

7. A golf club head made of metal, comprising:

a face surface; and a head body; wherein:

the head body includes:

a first hollow portion formed in a lower portion of the head body;

an elastic body inserted into the first hollow portion;

a hosel portion;

a face plate forming the face surface attached to a front surface of the head body;

an opening portion penetrating an upper portion of the head body in a back/forth direction thereof;

a recess portion in a lower portion of the head body, the recess portion being open to the face surface, wherein the first hollow portion is formed in the recess portion;

a recess step portion to which the face plate is fitted provided in the front surface of the head body; and a circumferential edge portion of the face plate fitted to the recess step portion is engaged with the head body by caulking the circumferential edge portion of the face plate;

wherein the elastic body is maintained under compression in the first hollow portion and the elastic body is affixed to a back surface of the face plate in the first hollow portion.

8. A golf club head made of metal, comprising:

a face surface; and a head body; wherein:

the head body includes a first hollow portion;

an elastic body is inserted into the first hollow portion;

the first hollow portion is formed only in a lower portion of the head body; and a second hollow portion communicating with the first hollow portion, wherein the elastic body is affixed to a wall portion in the first hollow portion.

9. The golf club head according to claim 8, wherein a depth of the first hollow portion is not smaller than 3.5 mm and not larger than 20 mm.

10. The golf club head according to claim 8, wherein JIS C hardness of the elastic body is in a range of 15–80.

* * * * *